US005890948A

United States Patent [19]

Nilsson

[11] Patent Number: 5,890,948

[45] Date of Patent: Apr. 6, 1999

[54] TOY BRIDGE

[75] Inventor: Claes-Ola Nilsson, Osby, Sweden

[73] Assignee: Brio AB, Sweden

[21] Appl. No.: 956,161

[22] Filed: Oct. 22, 1997

[30] Foreign Application Priority Data

Oct. 28, 1996 [SE] Sweden ..... 9603916

[51] Int. Cl.[6] ..... A63H 3/52; A63H 19/28; E01D 15/12; E01B 23/00

[52] U.S. Cl. ..... 446/476; 446/447; 14/2.4; 14/24; 238/10 E

[58] Field of Search ..... 446/476, 477, 446/478, 444, 446, 447; 14/2.4, 24, 69.5; 238/10 E; 104/126

[56] References Cited

U.S. PATENT DOCUMENTS

| | | | |
|---|---|---|---|
| 2,070,887 | 2/1937 | Dunn, Jr. et al. | 446/476 X |
| 2,452,888 | 11/1948 | Woodward | 238/10 E |
| 3,406,616 | 10/1968 | McLean | 14/24 |
| 3,896,582 | 7/1975 | Cohen | 446/476 X |
| 4,953,785 | 9/1990 | Keska | 238/10 E |

FOREIGN PATENT DOCUMENTS

| | | | |
|---|---|---|---|
| 462460 | 1/1950 | Canada | 446/476 |
| 562668 | 9/1993 | European Pat. Off. | 14/2.4 |
| 2262246 | 7/1973 | Germany | 446/476 |
| 2447419 | 4/1976 | Germany | 14/2.4 |

*Primary Examiner*—Robert A. Hafer
*Assistant Examiner*—D Neal Muir
*Attorney, Agent, or Firm*—Barnes, Kisselle, Raisch, Choate, Whittemore & Hulbert

[57] ABSTRACT

A toy bridge comprising a stand and, supported thereby, a bridge road element having a roadway on each of two opposite flat sides. The stand is turnable and can optionally be placed on a base in a first or second position, in which the bridge road element is arranged at a first or a second distance from the base and its one or other flat side faces upwards. A supporting yoke is arranged at each end of the bridge to form a support for a ramp road element connected to the bridge road element. The supporting yoke is pivotable relative to the bridge road element by the force of gravity between a first and a second stop position, in which it forms a subjacent support for the ramp road element when the stand is in its first and its second position, respectively.

4 Claims, 3 Drawing Sheets

TOY BRIDGE

FIELD OF THE INVENTION

The present invention relates to a toy bridge having a stand arranged to be placed on a base and supporting a board-like bridge road element for a toy vehicle, such as a rail element for a toy train, in such a manner that the bridge road element will be spaced from the base as the stand is placed on the latter, said bridge road element being arranged to be coupled at least at one of its ends to a ramp road element extending downwards towards the base, in order to form a continuous roadway together with the ramp road element.

One prior-art toy bridge of this kind is included in a toy railway kit, and the road element therein is adapted to be coupled to a ramp road element, the latter in turn adapted to be coupled to road elements of a different kind placed on the base, in order to form a continuous roadway or railway. The road elements are interconnected end-to-end with the aid of coupling means which in the case of wooden toy railways generally consist of tongue-and-groove joints formed at the ends of the road elements. The road elements are formed at each end with a groove or a tongue to be interconnected with a corresponding tongue and groove, respectively, at one end of an adjoining road element. The groove extends perpendicularly to the plane of the roadway, through the thickness of the road element, and at the inner groove end, as seen from the road element end in question, it is formed with a wider portion. At its free end, the tongue is formed with an enlarged portion configured in conformity with the wider portion of the groove. The tongue is to be fitted into the groove from above in a direction perpendicularly to the plane of the roadway. In this manner, the joint prevents two interconnected road elements from being pulled apart in the longitudinal direction of the roadway.

The two ends of the bridge road element extend somewhat past the stand. Since the groove of the joint extends through the thickness of the road element, it is necessary in order for a ramp road element that is coupled to a bridge road element to be maintained in position, to support it from below by means of one or several subjacent supports. Typically, such supports are in the form of blocks. In case the bridge road element is positioned high above the base, several supports are required, and consequently a railway kit may contain a considerable number of support blocks.

SUMMARY OF THE INVENTION

The object of the present invention is to provide a toy bridge so constructed that it may form both a low bridge not requiring the use of support blocks and a high bridge requiring at least a reduced number only of support blocks.

This object is achieved in accordance with the invention in a toy bridge of the kind defined in the introduction, said bridge road element having a roadway on one of its flat sides as well as on its opposite, other flat side, said stand being turnable and arranged to be placed on the base optionally in either one of two positions, viz. a first position, in which the bridge road element is spaced a first distance from the base with one flat side thereof facing upwards, and a second position, in which the bridge road element is spaced a second distance from the base with its other flat side facing upwards, a support member being arranged at least at said one end of the bridge road element to form a support for the ramp road element, when the latter is connected to the bridge road element, said support member comprising a support rod located beyond said one end of the bridge road element and extending in the transverse direction of said bridge road element in parallel with the two flat faces thereof, and said support member being pivotable relative to the bridge road element about a pivot axis extending in the transverse direction of the bridge road element, in order to be pivoted between a first and a second stop position, in which said support rod forms a subjacent support for the ramp road element, when the stand is in its first and its second position, respectively.

The stop positions of the support member preferably are defined by stop means formed on the stand and against which the support member abuts in its respective stop positions.

Preferably, the support member is configured as an essentially U-shaped yoke, the web portion of which forms said support rod and the two leg members of which are pivotally connected to the stand for pivotal movement about said pivot axis.

In accordance with one preferred embodiment each leg member of the yoke extends into its respective one of V-shaped grooves formed in the stand and said stop means are formed by the delimiting walls of said grooves against which walls the yoke leg members abut in the respective stop positions.

BRIEF DESCRIPTION OF THE DRAWINGS

The invention will be described in closer detail in the following with reference to the accompanying drawings, wherein.

DESCRIPTION OF A PREFERRED EMBODIMENT

Figure 1:
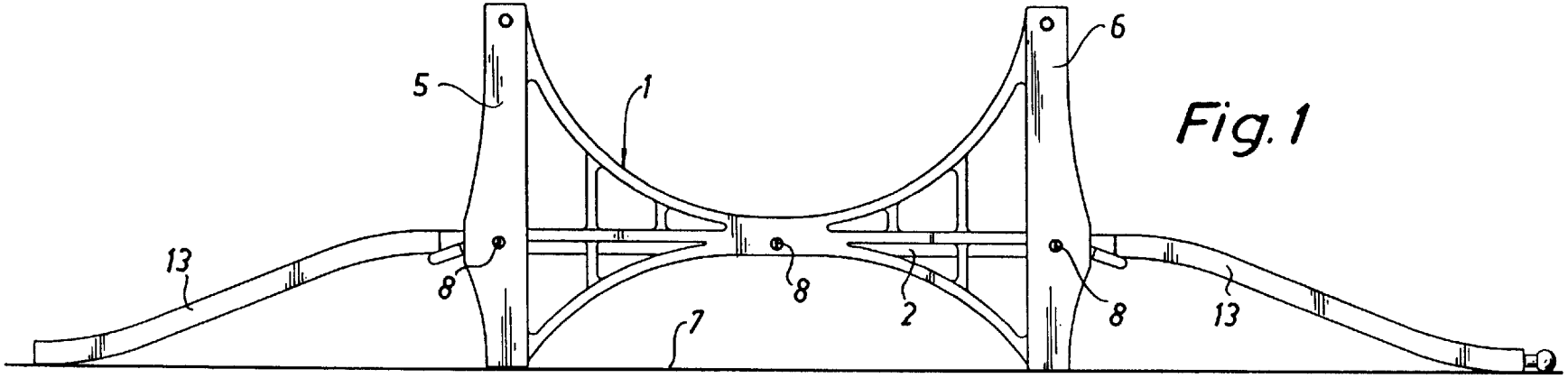
FIG. 1 is a lateral view illustrating a turnable toy bridge in accordance with the invention in a low-bridge position, the toy bridge being shown interconnected with ramp road elements.

The toy bridge illustrated in the drawing figures has a stand 1 of plastics material and a stand-supported, board-like wooden bridge road element 2. The stand 1 comprises two lateral pieces 3 and 4, each one of which has a vertical bridge-pillar 5, 6 at each end. The stand 1 rests on its four bridge-pillars 5 and 6 on a horizontal base 7, such as a floor. The bridge road element 2 is supported horizontally by the stand 1 and extends somewhat beyond the bridge-pillars 5 and 6 at either bridge end. The bridge road element 2 is attached to the stand 1 by means of screws 8, screwed into the lateral edges of the bridge road element 2 through bores formed in the lateral pieces 3 and 4. Cross pieces 9 and 10 interconnect the lateral pieces 3 and 4 at the upper part thereof, as seen in FIG. 1 (bottom as seen in FIG. 3), said cross pieces 9 and 10 extending between the bridge-pillars 5 and 6, respectively, of the two lateral pieces.

Figure 2:
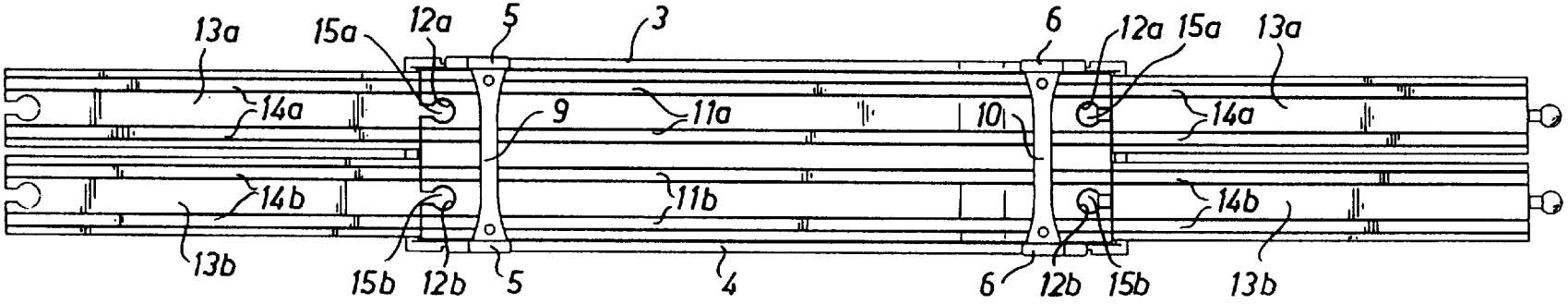
FIG. 2 is a view from above of the toy bridge in FIG. 1.

The toy bridge illustrated in the drawing figures is one of the components of a toy railway kit, and consequently the bridge road element 2 as illustrated is a rail element for a toy train. As illustrated in FIG. 2, the rail element 2 is a two-lane element, i.e. it has two juxtaposed pairs 11a and 11*b* of lengthwise extending tracks. Each one of the two flat side faces of the rail element 2 is formed with such a double-lane roadway. The stand 1 may be turned upside down, allowing it to be deposited on the base 7 either in a first position, viz. a low-bridge position (FIG. 1), in which the rail element 2 is spaced a first distance from the base 7 and one of its flat side faces upwards, and a second position, viz. a high-bridge position (FIG. 3), in which the rail element 2 is spaced a second distance from the base 7 and its opposite flat side faces upwards. As illustrated, the second distance is longer than the first one.

Figure 3:
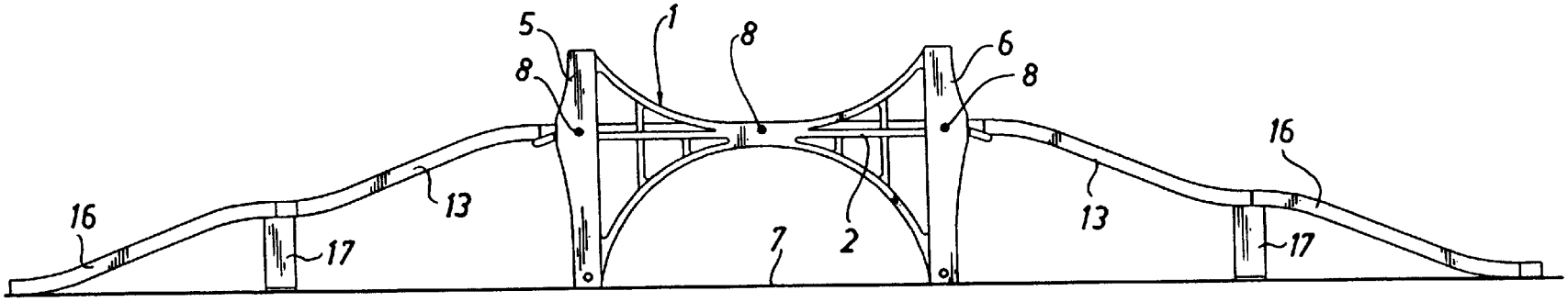
FIG. 3 is a view corresponding to FIG. 1 but illustrating the toy bridge in a high-bridge position.

The tracks of one track pair 11a and the tracks of the other track pair 11*b* formed in one of the flat sides of the rail element 2 (FIG. 2) are positioned in alignment with the corresponding tracks formed in the opposite flat side of the rail element, i.e. the flat side facing upwards in the high-bridge position illustrated in FIG. 3.

Intermediate the tracks of track pair 11*a* and intermediate the tracks of track pair 11*b* the rail element 2 is formed at each one of its ends with through grooves 12*a* and 12*b*, respectively. Each groove 12*a*, 12*b* extends perpendicularly to the flat sides of the rail element 2, all through the thickness of the rail element, and at the inner groove end, as seen from the rail element end, it is formed with a wider portion from which extends a narrower portion opening into the respective end edge face. These grooves 12*a*, 12*b* are employed for inter-connecting the rail element 2 at each bridge end with a ramp road element or a ramp rail element 13 sloping towards the base 7. In a manner similar to the rail element 2, each ramp rail element 13 could be made in one piece and be formed with double lanes but in accordance with the example in FIG. 2 it consists of two separate, juxtaposed one-lane pieces 13*a* and 13*b*, each with a separate pair of tracks 14*a* and 14*b*, which track pairs are prolongations of track pairs 11*a* and 11*b*, respectively. The pieces 13*a* and 13*b* are formed at one end thereof with a coupling tongue 15*a* and 15*b*, respectively, said tongues presenting at their free end an enlarged portion configured to match the wider portion of the grooves 12*a* and 12*b*. The coupling tongues 15*a* and 15*b* are inserted from above into the corresponding grooves 12*a* and 12*b*, respectively, in the rail element 2.

Consequently, the grooves 12*a* and 12*b* and the coupling tongues 15*a* and 15*b* form the kind of tongue-and-groove joint traditionally used in toy railways of this type. The joints prevent interconnected rail elements from being pulled apart in the longitudinal direction.

In the manner illustrated, the ramp rail elements 13 extend downwards into contact with the base 7 in the low-bridge position illustrated in FIG. 1, at which level tongue-and-groove joints of the kind described above interconnect the ramp rail elements with other rail elements (not shown) placed on the base 7. In the high-bridge position illustrated in FIG. 3, each ramp rail element 13 is coupled to an additional ramp rail element 16, each one of which, like the ramp rail elements 13, consists of two separate, juxtaposed one-lane pieces. These pieces are formed with one track pair each, said track pairs forming prolongations of track pairs 14*a* and 14*b*, respectively. A supporting block 17 is disposed underneath the ramp rail elements 13 and 16 at the point of interconnection. In the same manner as ramp rail elements 13 in the low-bridge position (FIG. 1), the ramp rail elements 16 are coupled to other rail elements (not shown) placed on the base 7.

Figure 6:
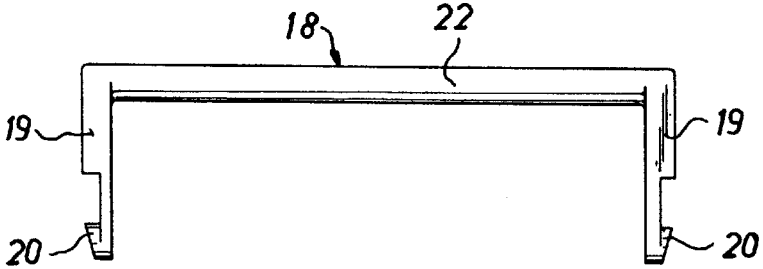
FIG. 6 is a view of a supporting yoke.
Figure 5:
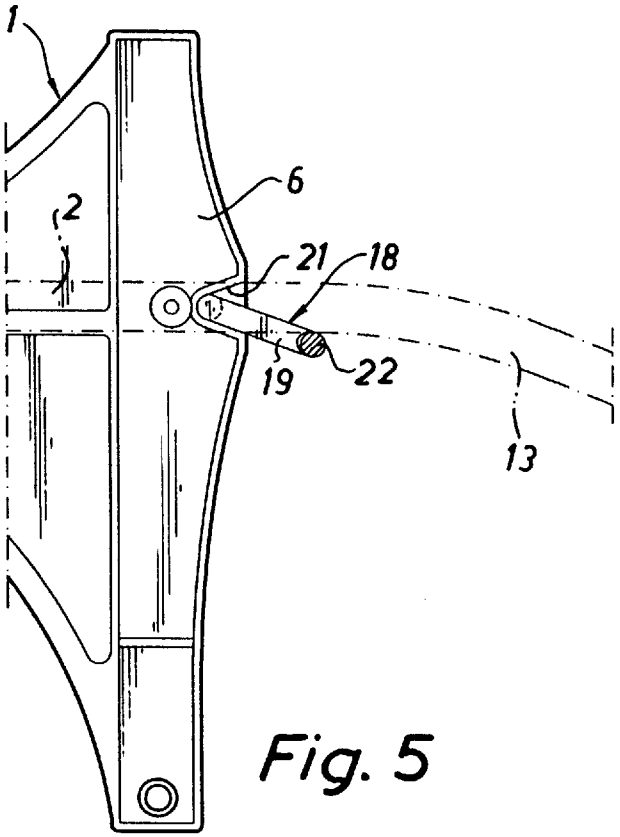
FIG. 5 is a view from the inside of a portion of a supporting pillar incorporated in the toy bridge stand, the toy bridge being in its high-bridge position.
Figure 4:
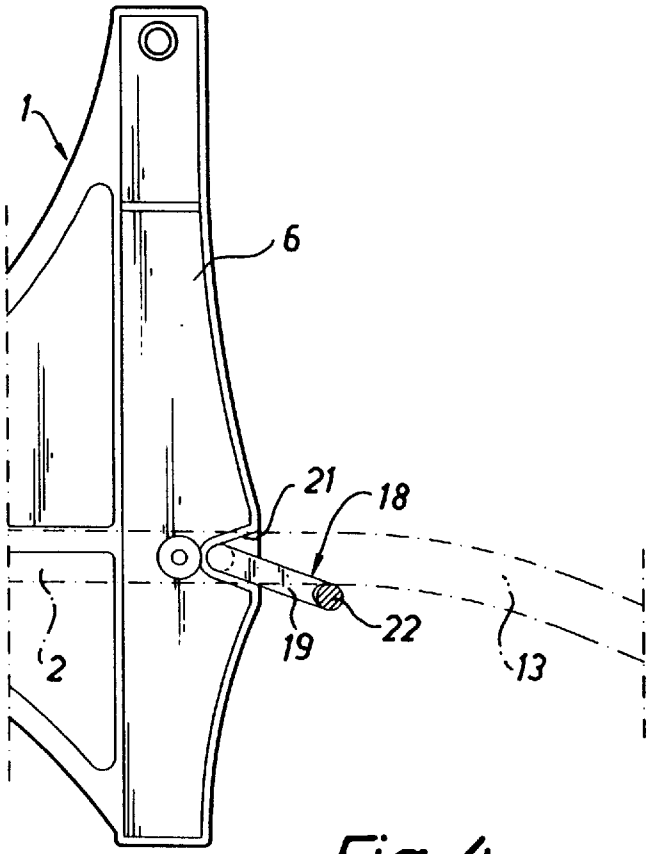
FIG. 4 is a view from the inside of a portion of a supporting pillar incorporated in the toy bridge stand, the toy bridge being in its low-bridge position.

At each end the stand 1 carries a supporting device configured as an essentially U-shaped yoke 18 (FIG. 6) made from plastics. The supporting yoke 18 forms a support for the associated ramp rail element 13 connected to the rail element 2. Each one of the two leg members 19 of the yoke 18 is formed at its free end with a laterally projecting pivot pin 20 and projects into a V-shaped recess 21 formed in each bridge-pillar 5, 6 on the inner face thereof (see FIGS. 4 and 5). Each pivot pin 20 is inserted in a mounting aperture formed in each bridge-pillar 5, 6 in the apex area of the V-shaped recess 21. Thus, the yoke 18 is pivotable about a horizontal pivot axis defined by the pivot pins 20 and extending at right angles to the longitudinal direction of the rail element 2. Owing to this arrangement, the yoke 18 is pivotable between a first stop position (FIG. 4) in which the yoke leg members 19 abut against one of the delimiting walls of the associated recess 21, and a second stop position (FIG. 5), in which the leg members 19 abut against the other delimiting wall of that recess. As appears from FIGS. 4 and 5, the yoke 18 is in the first stop position when the toy bridge assumes the low-bridge position, and in the second stop position, when the toy bridge assumes its low-bridge position.

The web portion 22 of the yoke 18 forms a support rod extending in parallel with the yoke pivot axis and located beyond the end of the rail element 2. The support rod 22 forms a subjacent support on which the ramp rail element 13 rests when interconnected with the rail element 2. When the yoke 18 assumes its stop positions, the support rod 22 is located at a level ensuring a smooth transition from the roadway of the rail element 2 to that of ramp rail element 13. The yoke 18 is shifted to the stop positions by the force of gravity.

What I claim and desire to secure by Letters Patent is:

1. A toy bridge comprising a stand arranged to be placed on a base and supporting a board-like bridge road element for a toy vehicle, such as a rail element for a toy train, in such a manner that the bridge road element will be spaced from the base as the stand is placed on the latter, said bridge road element being arranged to be coupled at least at one of its ends to a ramp road element extending downwards towards the base, in order to form a continuous roadway together with the ramp road element, said bridge road element having a roadway on one of its flat sides as well as on its opposite, other flat side, said stand being turnable and arranged to be placed on the base optionally in either one of two positions, a first position, in which the bridge road element is spaced a first distance from the base with one flat side thereof facing upwards, and a second position, in which the bridge road element is spaced a second distance from the base with its other flat side facing upwards, a support member being arranged at least at said one end of the bridge road element to form a support for the ramp road element, when the latter is connected to the bridge road element, said support member comprising a support rod located beyond said one end of the bridge road element and extending in the transverse direction of said bridge road element in parallel with the two flat faces thereof, and said support member being pivotable relative to the bridge road element about a pivot axis extending in the transverse direction of the bridge road element, in order to be pivoted between a first and a second stop position, in which said support rod forms a subjacent support for the ramp road element, when the stand is in its first and its second position, respectively.

2. A toy bridge as claimed in claim 1, wherein said stop positions of the support member are defined by stop means formed on the stand and against which the support member abuts in its respective stop positions.

3. A toy bridge as claimed in claim 2, wherein said support member is configured as an essentially U-shaped yoke, a web portion of said yoke forming said support rod and two leg members of said yoke being pivotally connected to the stand for pivotal movement about said pivot axis.

4. A toy bridge as claimed in claim 3, wherein each leg member of said yoke extends into its respective one of V-shaped recesses formed in the stand and wherein said stop means are formed by the delimiting walls of said grooves against which walls the yoke leg members abut in the respective stop positions.

* * * * *